US008171673B2

(12) United States Patent
Helms

(10) Patent No.: US 8,171,673 B2
(45) Date of Patent: May 8, 2012

(54) MOTORIZED DOOR OPENER FOR A VEHICLE

(75) Inventor: James M. Helms, Fort Myers, FL (US)

(73) Assignee: Ibis Tek, LLC, Butler, PA (US)

( * ) Notice: Subject to any disclaimer, the term of this patent is extended or adjusted under 35 U.S.C. 154(b) by 456 days.

(21) Appl. No.: 12/462,845

(22) Filed: Aug. 10, 2009

(65) Prior Publication Data

US 2010/0050524 A1 Mar. 4, 2010

Related U.S. Application Data

(60) Provisional application No. 61/190,135, filed on Aug. 26, 2008.

(51) Int. Cl.
*E05F 11/24* (2006.01)

(52) U.S. Cl. ..... 49/341; 49/339; 49/340; 49/343; 49/344; 49/502; 296/146.4; 296/106; 296/200; 296/56

(58) Field of Classification Search ..... 49/139, 49/140, 26, 339–344, 502; 296/146.4, 106, 296/56, 200; 105/332, 341, 343, 280, 286, 105/288, 296, 299; 16/86.1
See application file for complete search history.

(56) References Cited

U.S. PATENT DOCUMENTS

| | | | | | |
|---|---|---|---|---|---|
| 3,508,362 | A * | 4/1970 | Wright | 49/340 |
| 4,241,541 | A * | 12/1980 | Van Klompenburg et al. | 49/249 |
| 4,617,758 | A * | 10/1986 | Vetter | 49/324 |
| 4,943,104 | A * | 7/1990 | Zani et al. | 296/223 |
| RE34,230 | E * | 4/1993 | Tucker et al. | 49/279 |
| 5,375,374 | A * | 12/1994 | Rohraff, Sr. | 49/340 |
| 5,509,234 | A * | 4/1996 | Klimek et al. | 49/342 |
| 5,531,045 | A * | 7/1996 | Piltingsrud | 49/279 |
| 6,955,390 | B2 * | 10/2005 | Rigorth et al. | 296/146.4 |
| 2003/0145524 | A1 * | 8/2003 | Ihashi | 49/342 |
| 2005/0127711 | A1 * | 6/2005 | Rigorth et al. | 296/146.4 |

* cited by examiner

*Primary Examiner* — Jerry Redman
*Assistant Examiner* — Marcus Menezes
(74) *Attorney, Agent, or Firm* — Karen Tang-Wai Sodini

(57) ABSTRACT

A motorized door opener for a vehicle (such as a military or security vehicle), featuring a sensor system that determines door position to prevent door damage while the opener is in operation. The opener features an offset gear system that effectively changes the door's rotation point. Mechanical advantage is gained by using a lengthened lever arm with the gear system, providing increased leverage and allowing the motor to provide enough force to open and close a heavily armored door. The opener can use existing door hinges, and can be provided so as not to protrude into the door space, in order to facilitate passenger and equipment entry/exit through the doors. A safety release mechanism is included in some embodiments, allowing the door to be manually opened or closed.

5 Claims, 7 Drawing Sheets

MOTORIZED DOOR OPENER FOR A VEHICLE

CROSS REFERENCE TO RELATED APPLICATIONS

Reference is made to and priority claimed from U.S. provisional application Ser. No. 61/190,135 filed on Aug. 26, 2008.

FIELD OF THE INVENTION

The present invention pertains to the field of door openers. More particularly, the present invention pertains to the field of motorized door openers designed to open and close doors on motor vehicles.

BACKGROUND OF INVENTION

Military and security force motor vehicles are often armored to protect occupants from bullets, bombs and other threats, but armoring creates doors often weighing as much as 1000 pounds, making manually opening the door difficult or impossible when the vehicle is positioned on a sloped or other non horizontal surface. Also, attachments mounted to the outside of the doors create a problem where in a typical four door vehicle, having two doors per side, when the rear door is opened at a particular angle, the front door cannot open fully because the attachment protrudes into the path of the front door, blocking the front door from opening fully.

Thus, it would be advantageous to have a motorized door opener that automatically opens and closes the doors of a vehicle, but that can also sense the position of all the doors so that the opener does not damage any of the doors while the opener is in operation. Additionally, it would be advantageous for the motorized door opener to be able to use existing door hinges, negating the need to extensively modify or redesign the door itself. It would be further advantageous to have a door opener that does not itself protrude into the door opening, thus maximizing the entry/exit space for passengers and their equipment.

SUMMARY

The invention provides for a motorized door opener which automatically opens and closes a door, senses door position to ensure no door is damaged when the opener is in operation, and has an emergency feature that allows manual opening and closing of the door.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
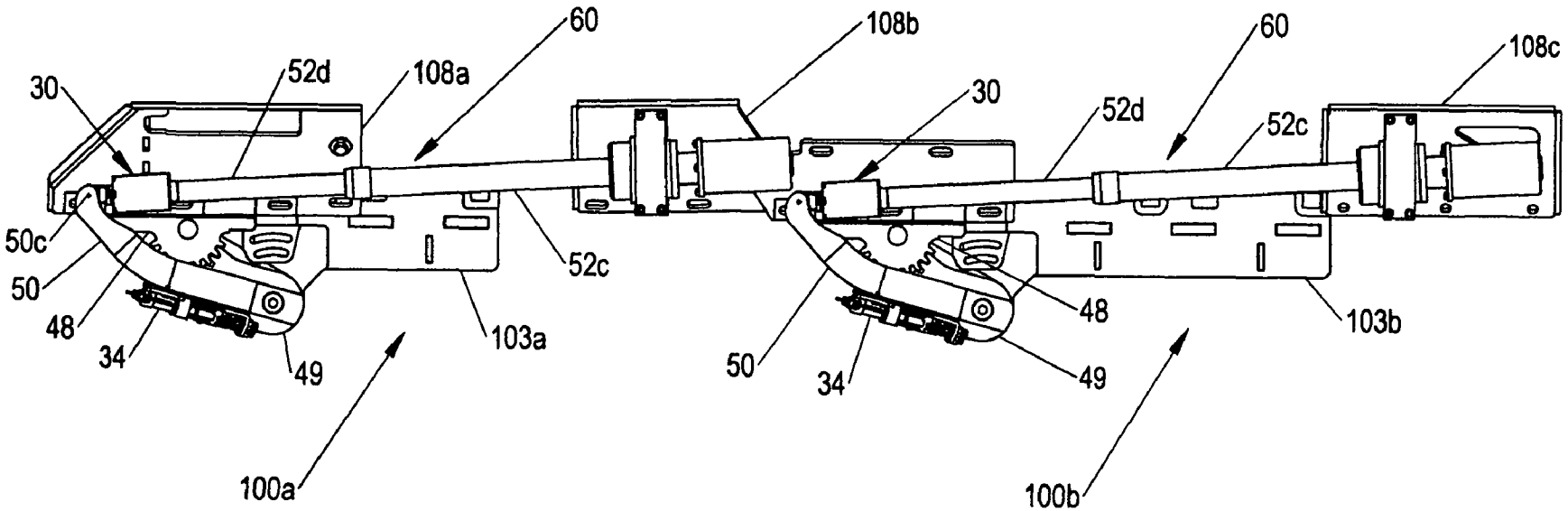
FIG. 1 is a top perspective view of a motorized door opener according to the invention.

The following is a list of reference labels used in the drawings to label components of different embodiments of the invention, and the names of the indicated components.

20 heim joint
24 safety release mechanism housing
24*c* distal end of the safety release mechanism housing
30 safety release mechanism
32 safety release lever
34 manual release (cable system)
36 notches in housing
46 mechanical control link
46*a* fastener for active gear defining a pivot point
46*b* fastener for gear rack defining the hinge and gear rack pivot point
48 gear rack
49 active gear
50 lever arm
50*a* lever arm first end
50*b* lever arm second end
50*c* attachment point to the linear motor
50*d* pitch diameter (center line of where the gear rack and the active gear meet)
52*a* motor first end
52*b* motor second end
52*c* cover tube
52*d* telescoping arm
54 position sensors
56 controller
60 linear motor including a cover tube and a telescoping arm
100*a* front door opener
100*b* rear door opener
102 vehicle roof
103*a* door adaptor
103*b* door adaptor
104 vehicle door hinge
105 rear vehicle door
105*a* interior rear vehicle door
105*b* exterior rear vehicle door
106 front vehicle door
106*a* interior front vehicle door
106*b* exterior front vehicle door
108*a* vehicle adaptor
108*b* vehicle adaptor
108*c* vehicle adaptor

DETAILED DESCRIPTION

The invention is described here in terms of an embodiment including two front door openers and two rear door openers, for opening armored doors of a HMMWV (High Mobility Multipurpose Wheeled Vehicle). It should be understood, however, that the invention has more general applicability. The invention can be used in case of any hinged door of a motor vehicle where the door extends in close proximity to the roof of the vehicle.

Referring to FIGS. 1 to 6, the invention provides front and rear motorized door openers 100*a* 100*b* for opening a front door 106 and a rear door 105 (FIG. 2) of a vehicle, respectively. The door openers provided by the invention are especially of use in case of an armored door, which can weigh several hundred pounds, such as a door of a HMMWV armored against blast. The front and rear motorized door openers are substantially the same in the embodiment shown and described here, the main difference being that the front and rear door openers use different door adapter plates 108*a-c*, 103*a-b* by which the door openers attach to the vehicle and to the doors.

In the embodiment of the invention shown in FIGS. 1-3 and 5 and focusing specifically on the front door opener 100*a*, the front door opener 100*a* includes a rigid mounted gear rack 48 having a plurality of teeth around a substantial part of its perimeter and a non-toothed side of the gear rack 48 affixed to a vehicle adaptor 108*a* that is in turn affixed to a vehicle roof 102, and an active gear 49 having a plurality of teeth around its perimeter, the teeth of the gear rack 48 constantly meshed with the teeth of active gear 49. Gear rack 48 and active gear 49 are pivotally attached to a mechanical control link 46 by fasteners 46*a* and 46*b* defining respective pivot points, so that the mechanical control link 46 holds the active gear and gear rack in constant contact by holding the respective pivot points at a fixed separation. The mechanical control link 46, shown more particularly in FIGS. 4 and 6, is affixed to a door adaptor 103*a*, that is in turn affixed to a top of a vehicle door 105, 106.

Figure 6:
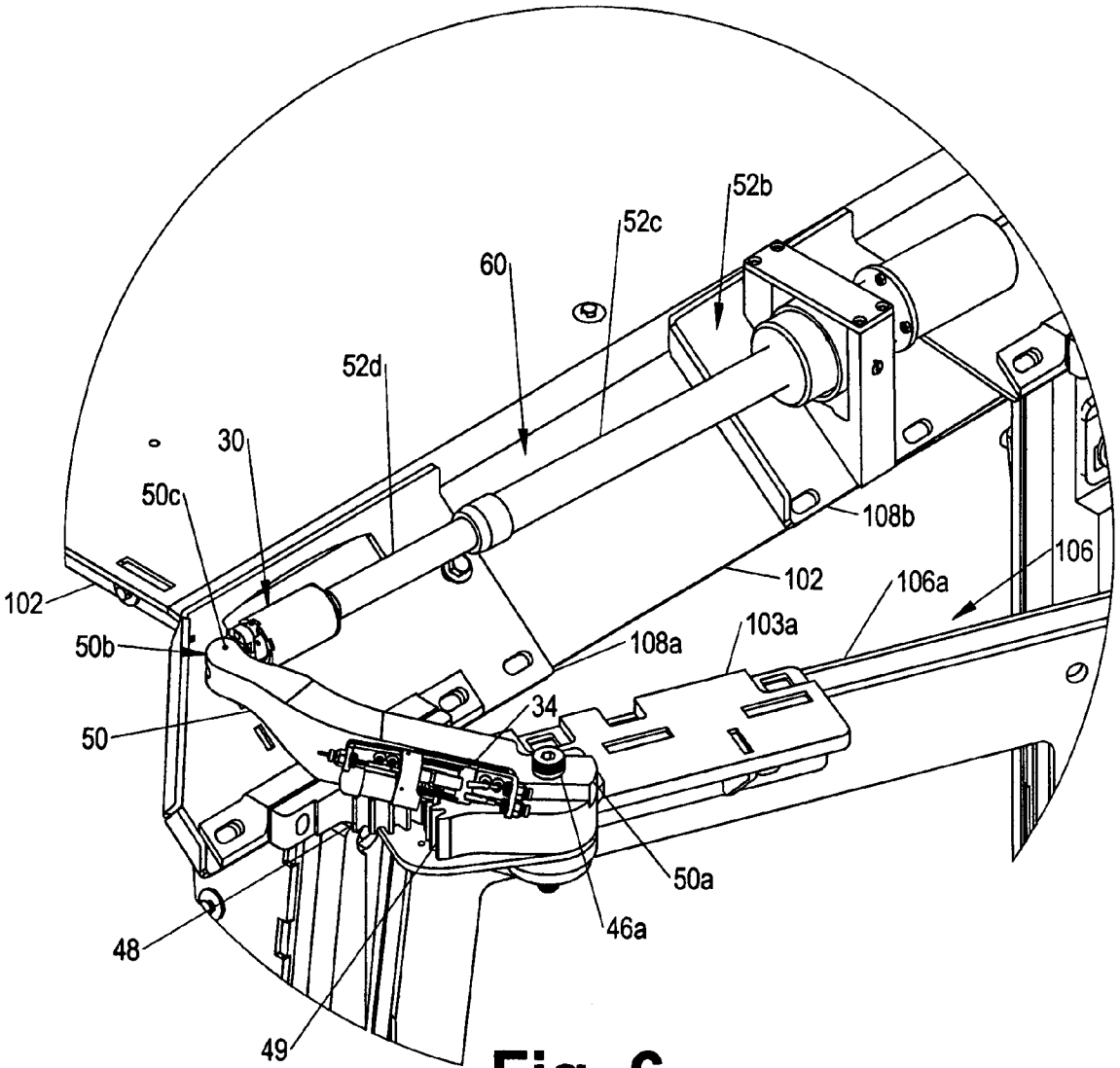
FIG. 6 is a perspective view of a safety release mechanism and the lever arm.

Referring now to FIG. 6, a lever arm 50 having a first end 50*a* and a second end 50*b* is attached to the active gear 49 at a first end 50*a*, and at the second end 50*b*, the lever arm is attached to a first end 52*a* of a linear motor 60 at a point 50*c*, the motor having a telescoping arm 52*d* and a cover tube 52*c*. The motor housing is attached to a vehicle roof 102 by vehicle adaptor 108*b*. When the motor is activated in one direction, the telescoping arm 52*d* retracts into the cover tube 52*c*, causing the lever arm 50 to swing the vehicle front door 106 open (FIG. 3). When the motor 60 is operated in the opposite direction, the motor forces the arm 52*d* to extend out of the cover tube 52*c*, causing the lever arm 50 to close the front door 106 (FIG. 2).

Figure 2:
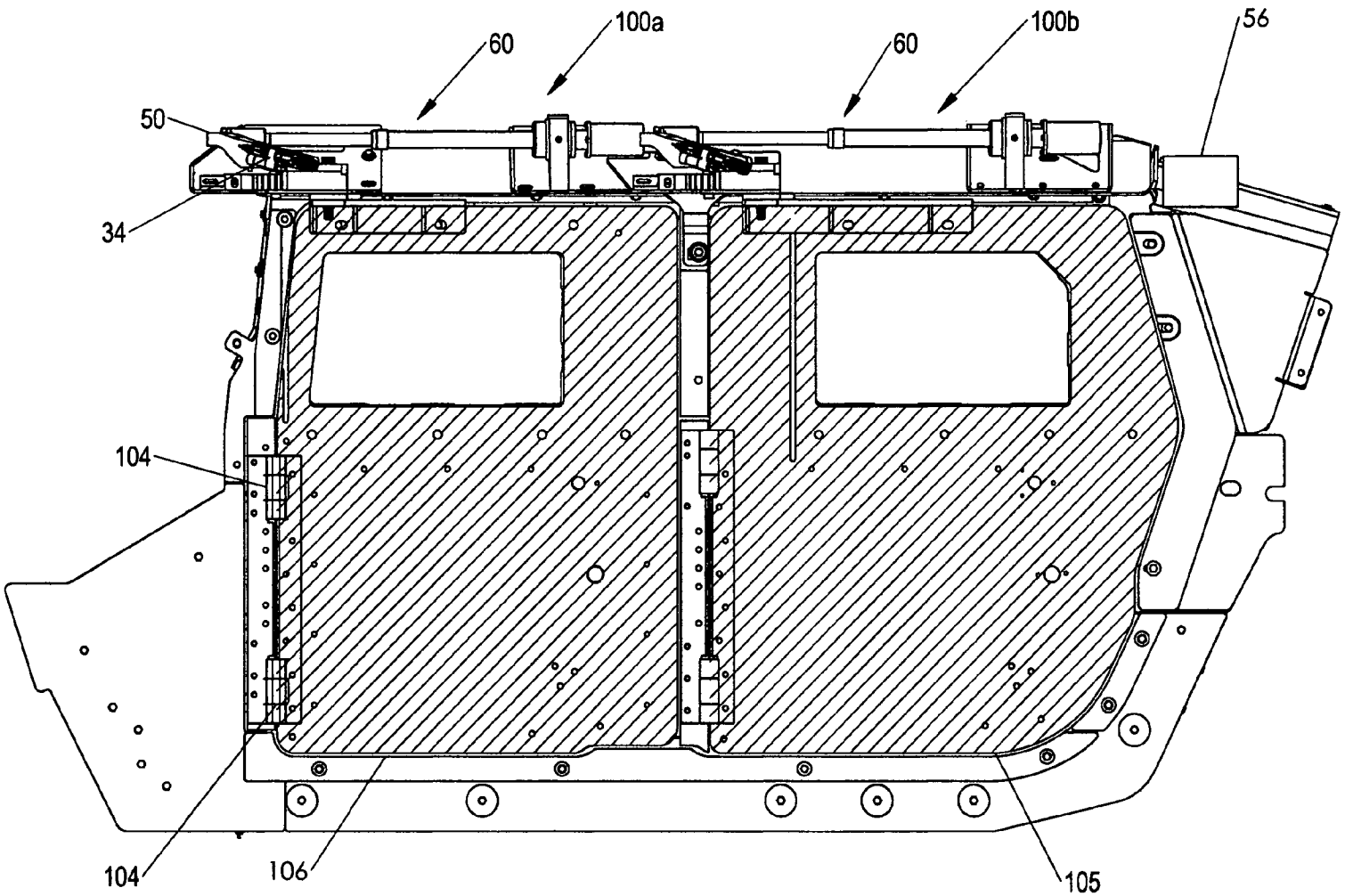
FIG. 2 is a side perspective view of the door opener attached to a vehicle body with the door in a closed position.
Figure 3:
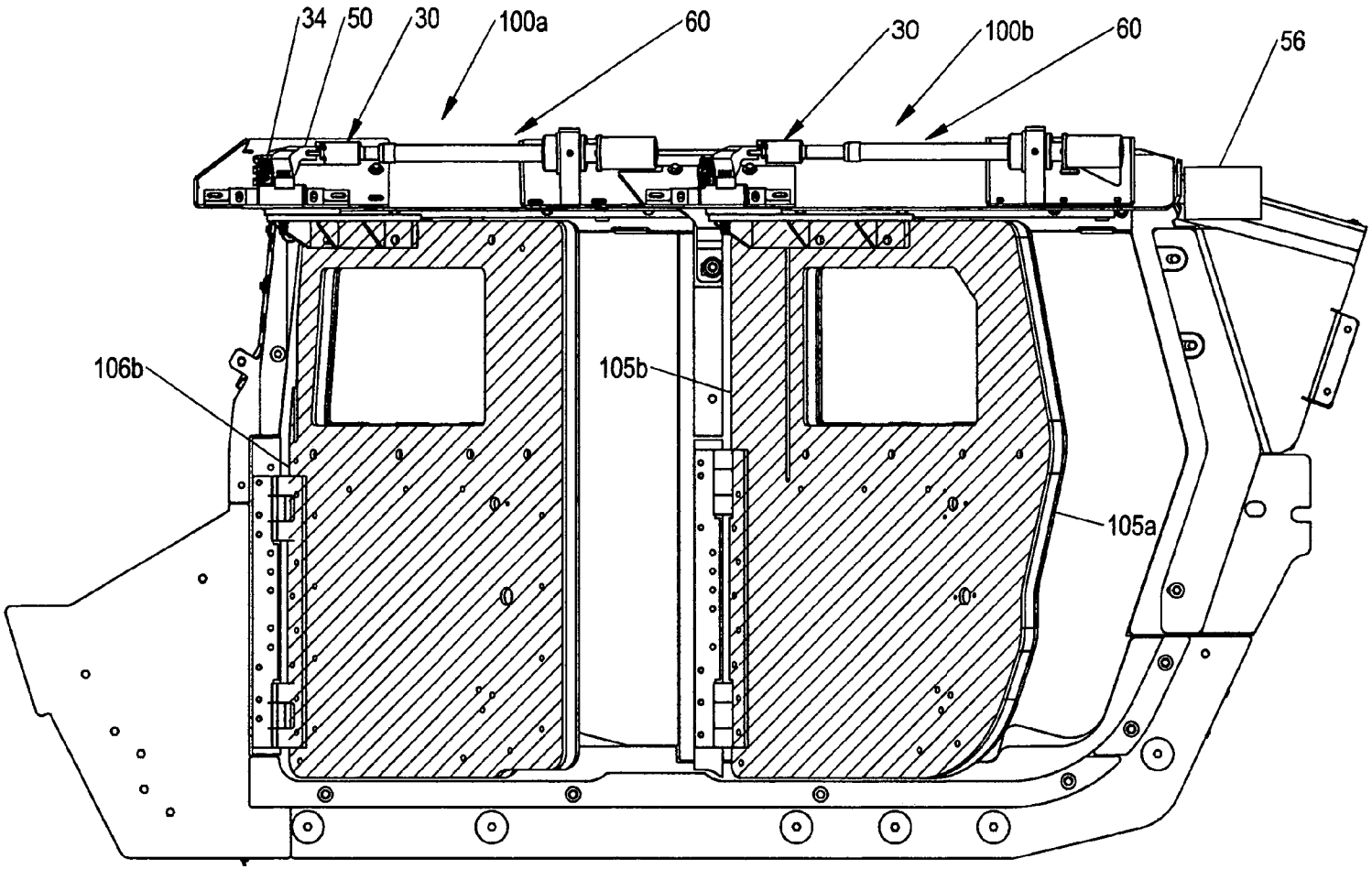
FIG. 3 is a perspective view of the door opener attached to a vehicle body with the door in an open position.
Figure 4:
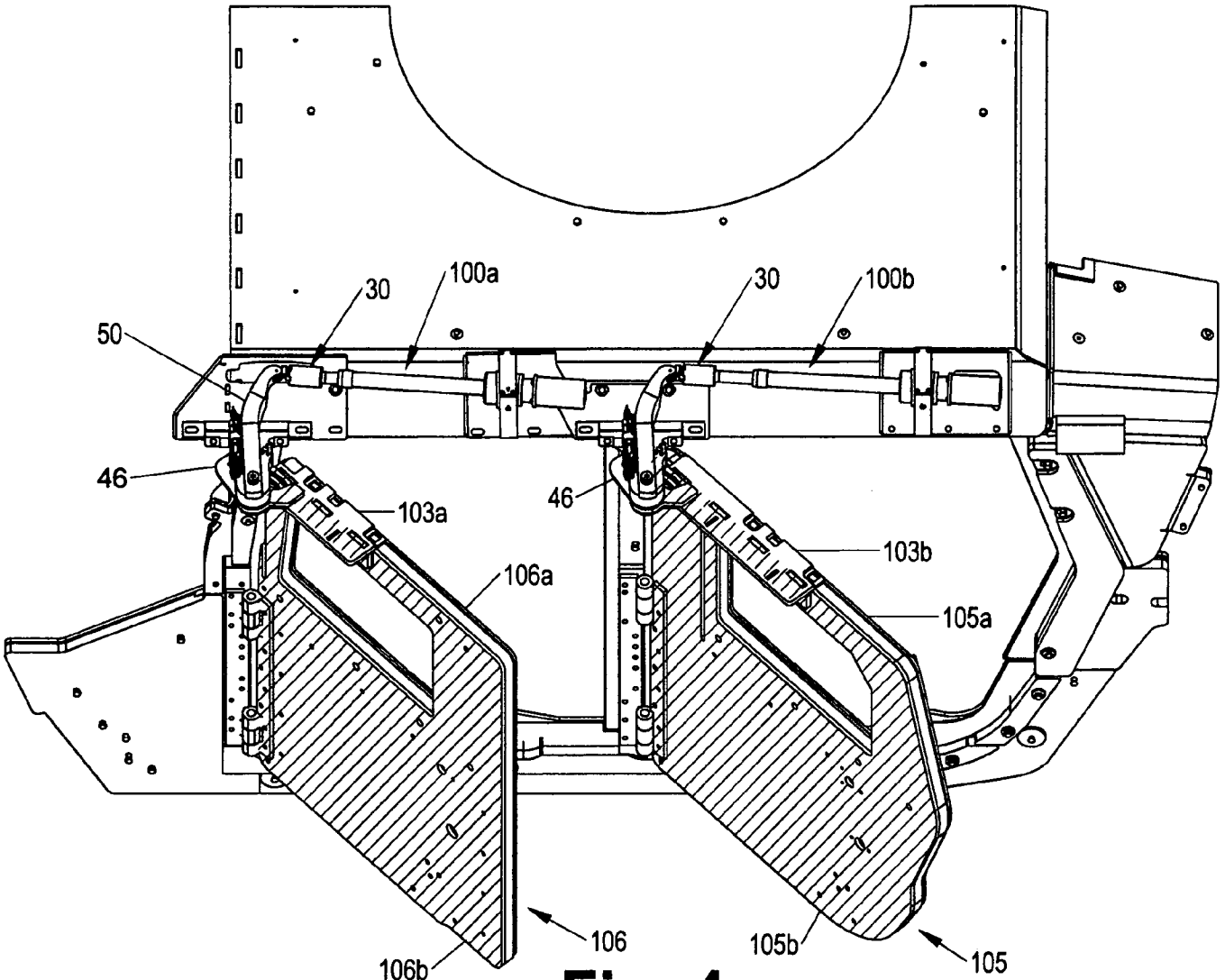
FIG. 4 is a top perspective view of the door opener attached to a vehicle body and to a front door and a rear door, both doors in open position showing the location of the opener with respect to the door opening.

Referring now to FIGS. 2, 3 and 4, which show perspective views of the vehicle's front and rear doors in closed and opened positions, and FIG. 6, showing the front door opener 100*a* in detail (which detail is also representative of the rear door opener 100*b*) the invention according to some embodiments also includes a smart door software system, comprising logic hosted by a controller 56 (FIG. 3), position sensors 54 (FIGS. 4 and 5) and actuation sensors (not shown). The smart door software system senses the position of all the doors when the opener is in operation, and prevents opening a door in case of possible interference. This is necessary because exterior armoring (not shown) on the rear door 105 interferes with the path of opening for the front door 106 when the rear door 105 is opened prior to opening the front door 106. An actuation sensor (not shown) mounted inside a door handle (not shown) on each interior door 105*a*, 106*a* sends information to the controller 56 to signal the actuator 52 to operate. The logic in the controller 56 requires that the front door 106 must be completely open before rear door 105 can be opened through its entire range of motion. While the front door 106 is closed, the rear door 105 can be opened just far enough so that the front door 106 can open without interference. Once the front door 106 is opened past the point of interference, the rear door 105 can be opened further.

Figure 5:
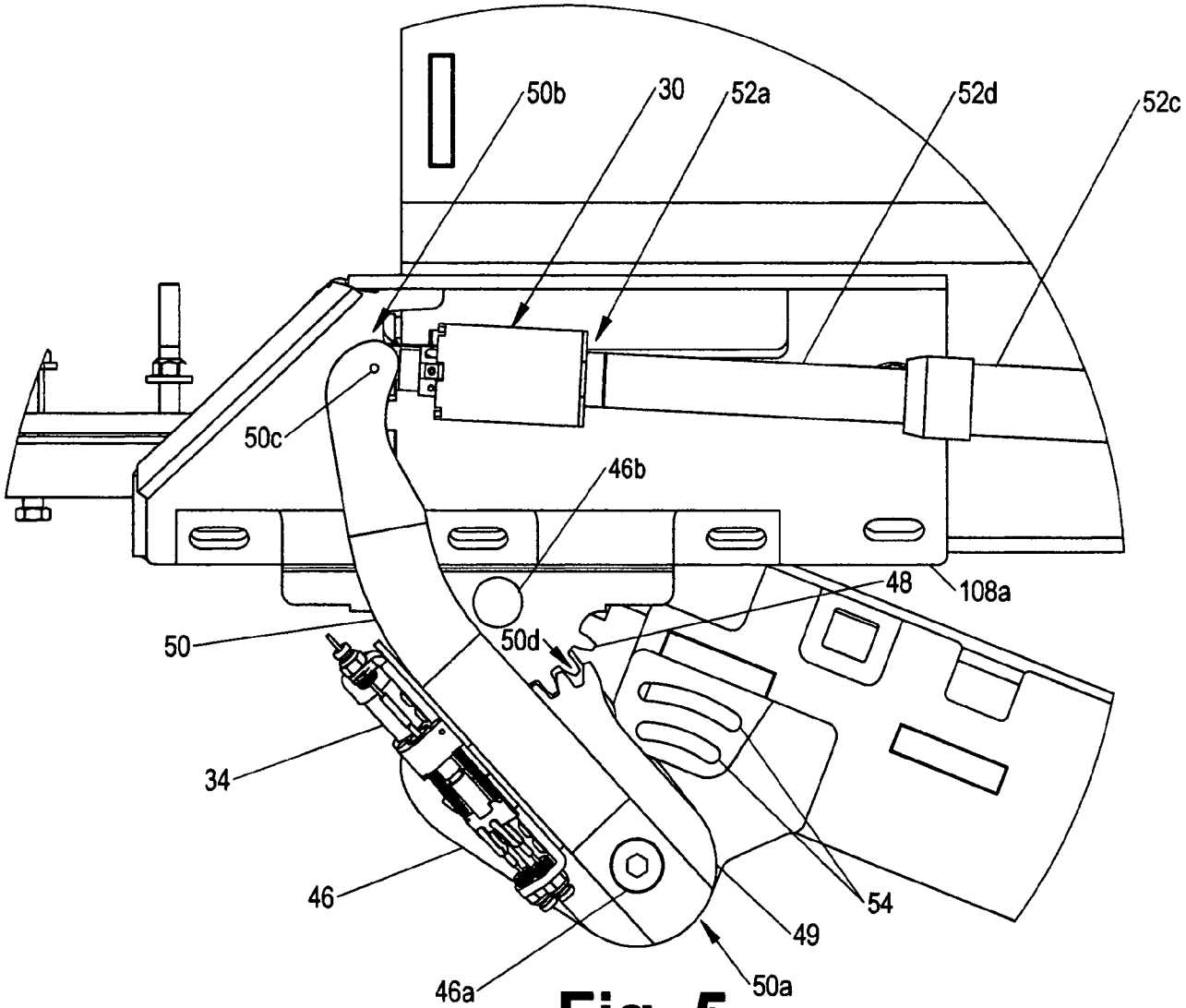
FIG. 5 is a perspective view of a mechanical control link.

FIGS. 2 and 5 illustrate the mechanical advantage obtained by the offset gear design of the door opener. The gear assembly offset mount effectively moves the center of rotation of the door from the vehicle door hinge 104 (shown in FIG. 2) to the gear rack 48 (shown in detail in FIG. 5). In one embodiment of the invention, the lever arm 50 is bent, as shown FIGS. 1-6, however a straight lever arm will also provide the additional leverage to the motor 60 so enough force is generated to open and close the heavy vehicle door. The gear rack 48 and the active gear 49 are constantly held in meshed position by the mechanical control link 46 (FIGS. 4, 5 and 6), which prevents the meshed teeth from slipping due to vehicular or other movement. The gear rack and active gear are sized so as to shorten the mechanical link between the first end of the lever arm 50*a* and the pivot point of the gear rack 46*b*, this point 46*b* being directly above the vehicle door hinge 104, thereby providing an increased mechanical advantage. The mechanical advantage is defined as the ratio of the difference of the distance between the attachment point 50*c* of the lever arm to the motor and the pivot point 46*a* to the difference of the distance from the pivot point 46*a* and a pitch diameter 50*d*. The pitch diameter 50*d* is defined as the center line at which the teeth of the active gear and the gear rack meet, where there is no sliding of the teeth against one another.

As seen in FIGS. 2-4, the door opener according to some embodiments of the invention is designed to be mounted to the vehicle's roof 102 and the top of doors 105, 106 so that the opener parts neither protrude down into nor stick out over the door opening. Passengers entering and exiting the vehicle are not obstructed by the opener and do not need to stoop to avoid the opener parts. The original door opening profile is unchanged by the addition of the door opener.

Figure 7:
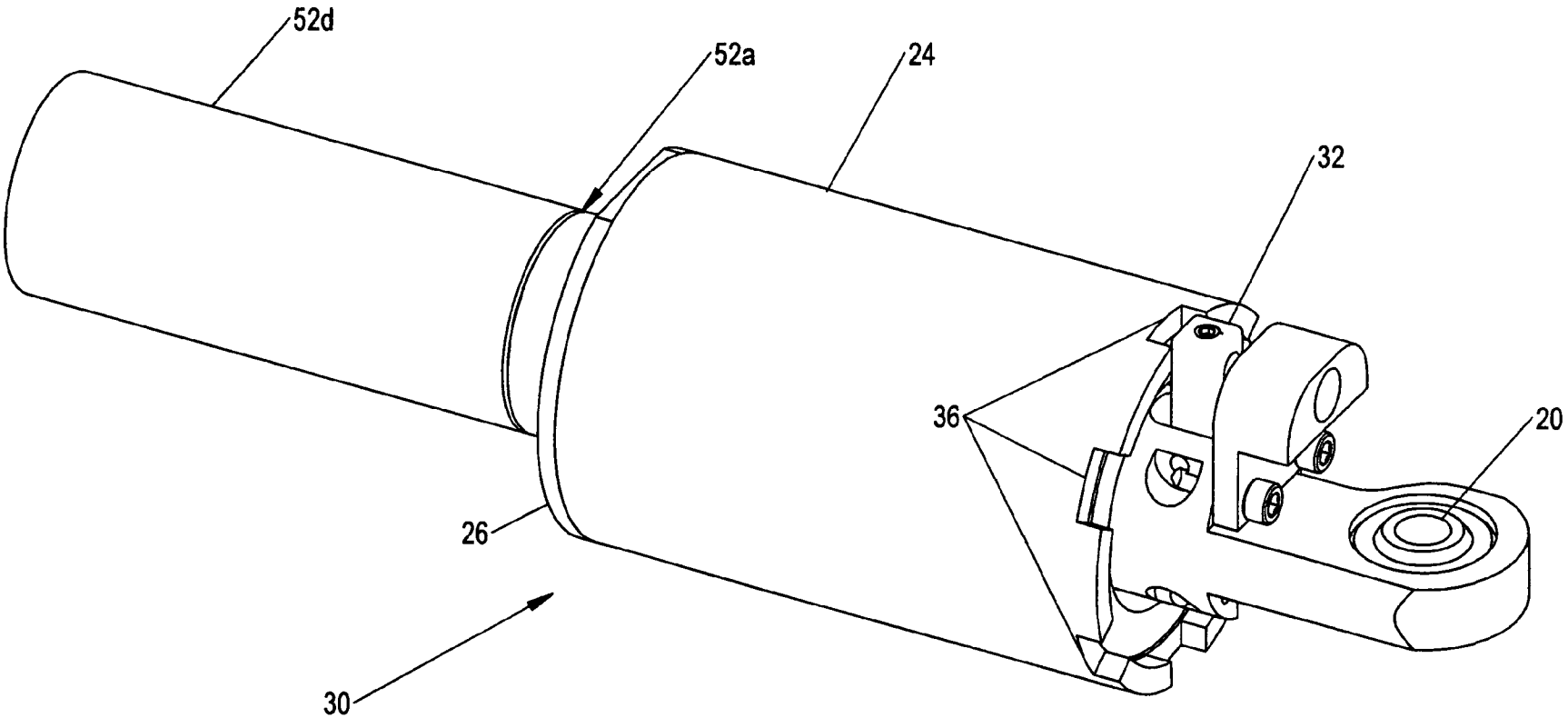
FIG. 7 is a detailed perspective view of a mechanical bearing housing attached to an end of the actuator and showing the safety release lever in an engaged position.

Some embodiments of the invention include a safety release mechanism 30 (FIGS. 6 and 7) that is sandwiched between the motor first end 52*a* and the lever arm second end 50*b*. The mechanism 30 is screwably attached to the telescoping arm of the motor, and disengagably coupled to the lever arm second end by a heim joint 20. When locked or engaged, the mechanism prevents the free rotation of the telescoping arm 52*d* by positioning a safety release lever 32 inside at least one notch 36 about the periphery of the mechanism's distal end 24*c*. To disengage the release mechanism, for instance in an emergency situation or when electrical power is lost, the door can be manually opened or closed by pulling the release lever 32 out its position nestled inside a notch 36, allowing the telescoping arm 52*d* and the housing 24 to rotate freely in and out of the cover tube. The safety release lever 32 can be locked or opened from inside or outside the vehicle using a mechanical system, such as a manual release, comprising a cable pull system 34, serving as an emergency backup to the electrical system.

The safety release mechanism 30 as described is made by Ibis Tek, LLC (no part number available yet). The linear motor 60 with the telescoping arm as shown particularly in FIG. 1 is available as a single unit from Motion Systems Corporation of Eatontown, N.J., part number 85261.

Thus, the embodiment of the invention described herein provides an automatic door opener for opening a door by pulling on a lever arm attached to a linear motor (and for closing the door by pushing on the lever arm), and arranged to provide substantial mechanical advantage in turning a gear of a gear assembly disposed to open and close a door. The door gear assembly includes a mechanical control link that accommodates flexure of the body to which the door opener is attached. In some embodiments, the door opener includes a safety release mechanism of use in case of a linear motor using a ball screw as a basis for pushing or pulling on the lever arm. It should be noted that other embodiments of the door opener provided by the invention are not limited to linear motors, and a hydraulic motor could be used instead of a linear one. For a hydraulic motor, if a release mechanism is desired, a different release mechanism could be developed.

It is to be understood that the arrangements shown and described above and in the attachments are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A motorized opener for opening and closing a vehicle door, the opener comprising:

a linear motor (60) having an extensible arm (52*d*) and a cover tube (52*c*), the motor including bracketry for mounting to a vehicle roof above a door opening;

a gear rack (48) having a plurality of teeth about its perimeter, the gear rack including bracketry for rigidly affixing the gear rack to the vehicle roof;

an active gear (49) having a plurality of teeth about its perimeter, the teeth of the active gear sized to mesh with the teeth of the gear rack, and the active gear (49) disposed so as to be in gear communication with the gear rack (48);

a mechanical control link (46) pivotally attached to the active gear (49) and the gear rack (48) by fasteners (46*a* 46*b*) serving as respective pivot points, wherein the mechanical control link holds the active gear (49) and gear rack (48) in a constant spaced apart relationship throughout the travel path of the door; and a lever arm (50) having a first end (50*a*) and a second end (50*b*), the first end affixed to the active gear (49) and to the door and the second end affixed to the extensible arm (52*d*) of the linear motor (60); and wherein the gear rack fastener (46*b*) is provided so as to serve as a pivot point for both a door hinge (104) and the gear rack (48); and wherein the gear rack (48) and the active gear (49) are sized so as to shorten to the length of the mechanical link (46) between the first end of the lever arm (50*a*) and the gear rack pivot point (46*b*).

2. The door opener of claim 1, further comprising a smart door software system, the system comprising logic hosted by a controller (56) in communication with position sensors (54) and actuation sensors, whereby the position of all doors is sensed when the opener is in operation and prevents a door from opening in case of possible interference.

3. The software of claim 2, wherein the actuation sensors are mounted inside a door handle, whereby the sensors send information to the controller to signal an actuator to operate.

4. The door opener of claim 1, further comprising door adaptor plates, the plates shaped to conform to the dimensions of the top surfaces of the door opening and to the door, wherein the plates are affixed to both the mechanical control link and to the door opening top surfaces.

5. The door opener of claim 1, further comprising a safety release mechanism (30), whereby the mechanism can be manually disengaged, allowing the extensible arm (52*d*) to rotate freely in and out of the cover tube (52*c*).

* * * * *